US007207666B2

(12) United States Patent
Ord et al.

(10) Patent No.: US 7,207,666 B2
(45) Date of Patent: Apr. 24, 2007

(54) PRINTER INK SUPPLY SYSTEM

(75) Inventors: Jason S. Ord, Portland, OR (US); Alan Shibata, Camas, WA (US); Justin M. Roman, Portland, OR (US); Timothy A. Longust, Vancouver, WA (US); Lap T. Nguyen, Vancouver, WA (US); Laurie L. T. Ramos, Vancouver, WA (US); David L. Whalen, Vancouver, WA (US); Robert L. Battey, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 260 days.

(21) Appl. No.: 10/636,925

(22) Filed: Aug. 7, 2003

(65) Prior Publication Data

US 2005/0030353 A1 Feb. 10, 2005

(51) Int. Cl.
*B41J 2/175* (2006.01)

(52) U.S. Cl. ..... 347/85

(58) Field of Classification Search ..... 347/7, 347/19, 85, 86; 271/114
See application file for complete search history.

(56) References Cited

U.S. PATENT DOCUMENTS 4,342,042 A * 7/1982 Cruz-Uribe et al. ..... 347/7
4,709,246 A 11/1987 Piatt et al.
5,359,357 A 10/1994 Takagi et al.
5,408,746 A 4/1995 Thoman et al.
5,642,143 A 6/1997 Rhoads
5,731,824 A * 3/1998 Kneezel et al. ..... 347/7
5,844,580 A 12/1998 Barinaga et al.
5,856,839 A * 1/1999 Aukstikalnis et al. ..... 347/86
5,963,225 A 10/1999 Sugiyama
5,966,155 A 10/1999 Pawlowski, Jr. et al.
5,971,529 A 10/1999 Pawlowski, Jr. et al.
6,065,826 A 5/2000 Robinson et al.
6,123,406 A 9/2000 Imai
6,150,651 A 11/2000 Shibata et al.
6,170,942 B1 * 1/2001 Ogawa et al. ..... 347/88
6,209,981 B1 4/2001 Hirano
6,224,191 B1 5/2001 Saito et al.

(Continued)

OTHER PUBLICATIONS

HP Business Inkjet 3000 Printer Series—Overview and Features, printed on Jun. 17, 2003 from www.hp.com/cgi-bin/pf-new.cgi?IN=http%3A%2F%2Fh10010.www1.hp.com/wwpc/us/en/sm/W..., 3 pages.

(Continued)

*Primary Examiner*—Anh T. N. Vo

(57) ABSTRACT

An ink supply station for use with a first ink supply and a second ink supply includes a first module and a second module releasably coupled to the first module. The first module includes a first chassis and a first movable member supported by the chassis, wherein movement of the member causes flow of ink from the first ink supply. The second module includes a second chassis and a second movable member supported by the second chassis. Movement of the second member causes flow of ink from the second ink supply.

67 Claims, 10 Drawing Sheets

U.S. PATENT DOCUMENTS 6,276,780 B1 8/2001 Carrese et al.
6,312,086 B1 11/2001 Saito et al.
6,543,867 B1 4/2003 Jones
6,554,381 B2 4/2003 Locher et al.
6,557,971 B1 5/2003 Vega et al.
6,578,941 B2 6/2003 Arai et al.
6,899,326 B2 * 5/2005 Kawakami et al. ..... 271/114

OTHER PUBLICATIONS

HP Business Inkjet 3000 3000n 3000dtn User's Guide, 2002, 27 pages.

* cited by examiner

FIG. 5
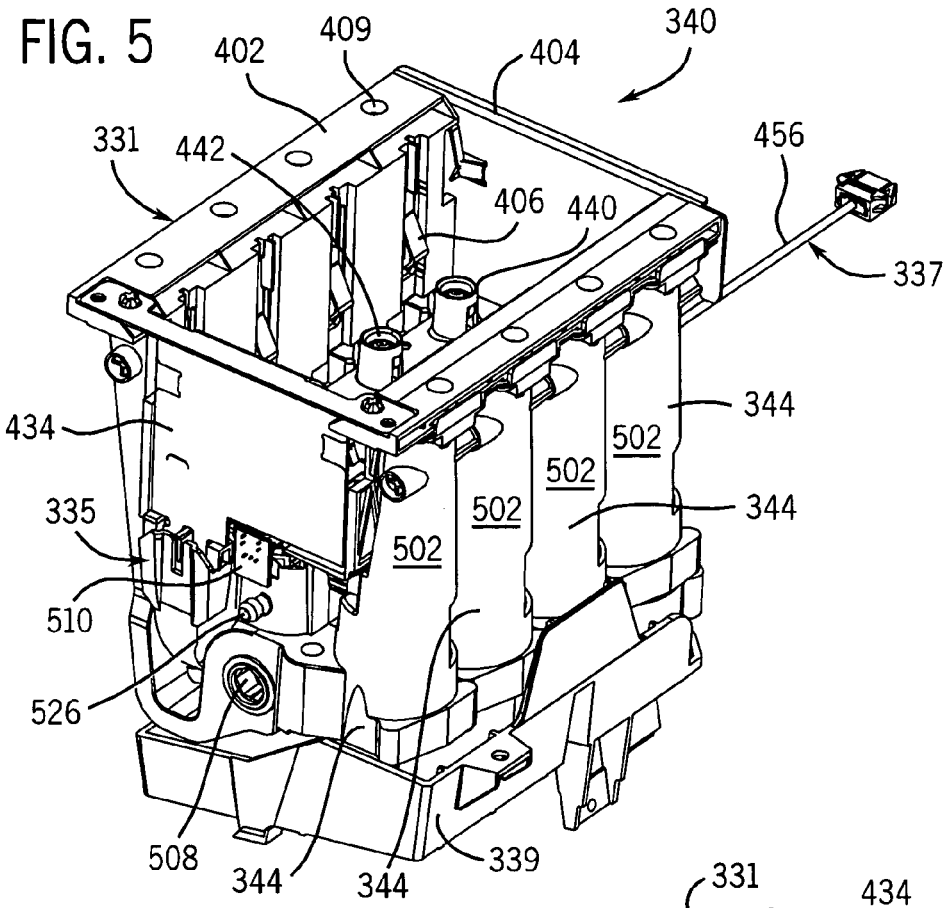
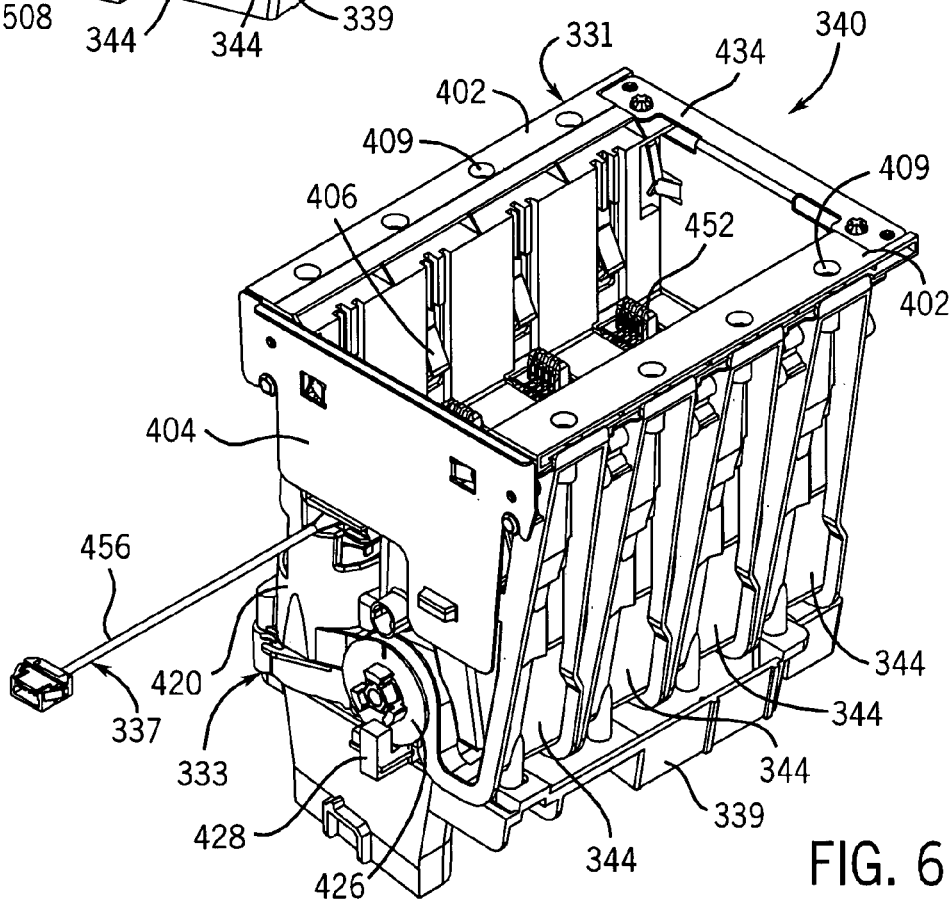
FIG. 6

FIG. 10
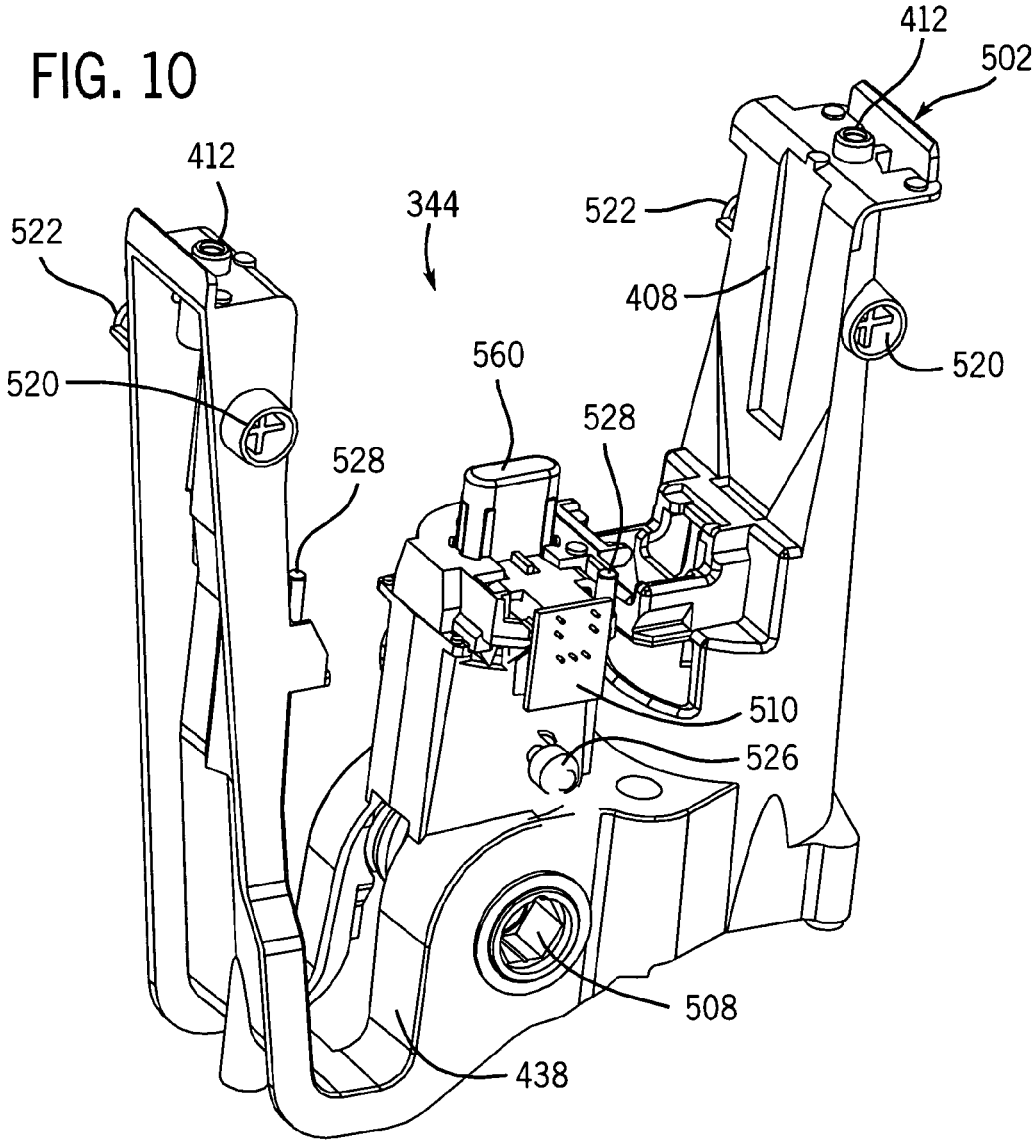
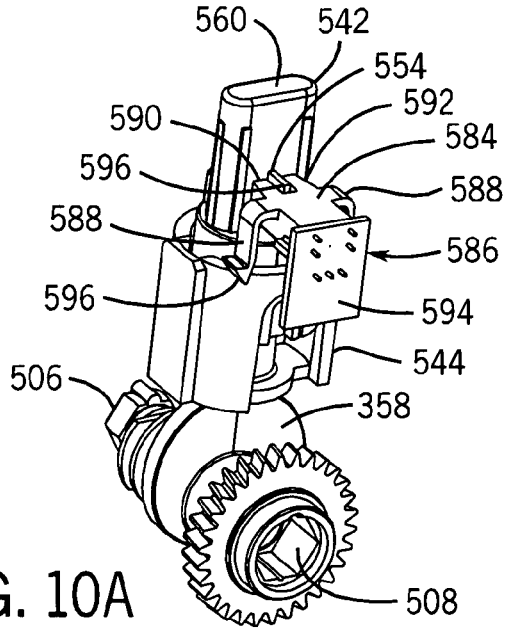
FIG. 10A

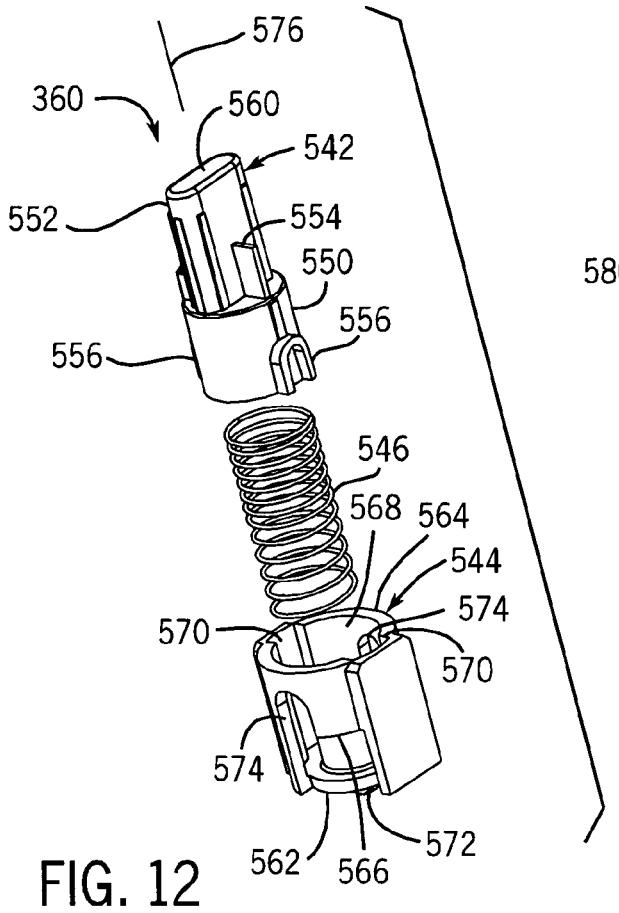
FIG. 12
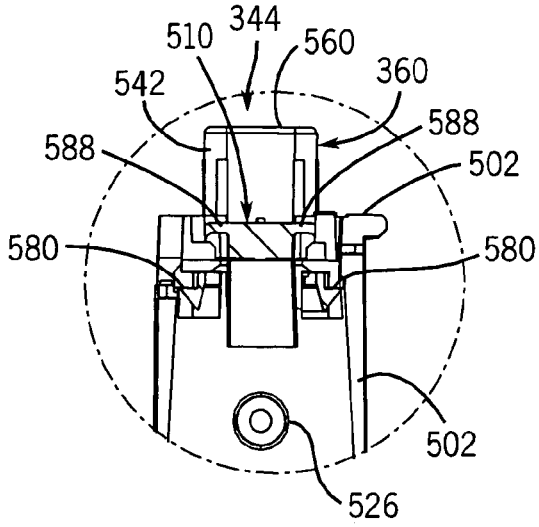
FIG. 14
FIG. 13
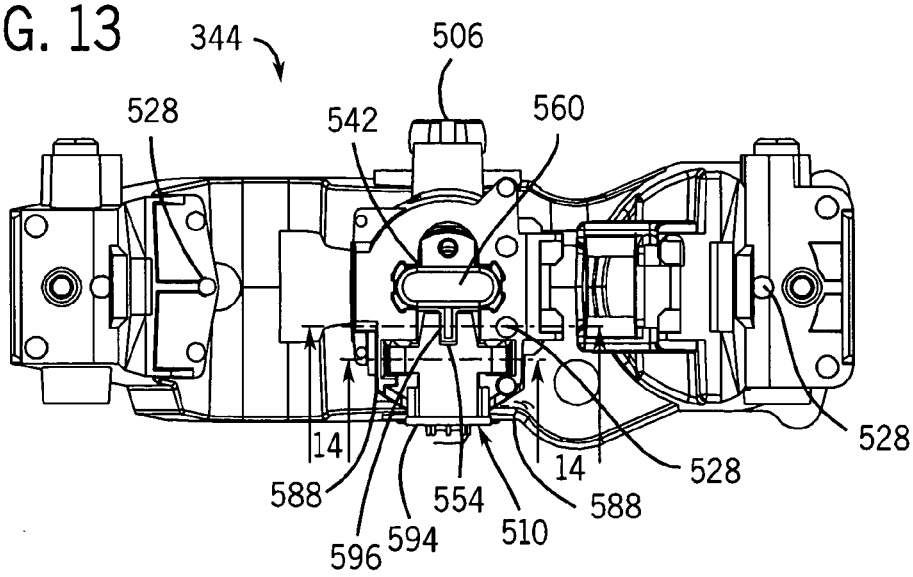

PRINTER INK SUPPLY SYSTEM

BACKGROUND OF THE INVENTION

Inkjet printers create an image by depositing liquid ink upon a medium. Such inkjet printers typically include a printhead and a reservoir or source of ink. In a first known inkjet printer, both the printhead and the ink reservoir are provided as a single print cartridge which is scanned across a page during printing. In a second known inkjet printer, only the printhead is scanned across the page. The ink reservoir is located off-axis and provides liquid ink to the printheads through flexible tubing extending between the ink reservoir and the printheads. U.S. Pat. No. 5,966,155 illustrates one example of a printer having an off-axis ink supply.

BRIEF DESCRIPTION OF THE DRAWINGS

FIG. 5 is a front perspective view of an ink supply station of the printer of FIG. 4.

FIG. 6 is a rear perspective view of the ink supply station of the printer of FIG. 4.

FIG. 10 is a rear perspective view of a single module of the ink supply station of FIG. 5.

FIG. 10A is a perspective view of a mechanical power transmission input portion, a mechanical power transmission output portion, a drive system, a pressurization system and a sensor of the module of FIG. 10.

FIG. 12 is an exploded perspective view of the pressurization system of FIG. 10A.

FIG. 13 is a top plan view of the module of FIG. 10.

FIG. 14 is a sectional view of the module of FIG. 13 taken line 14—14.

DETAILED DESCRIPTION OF THE EXEMPLARY EMBODIMENTS

Figure 1:
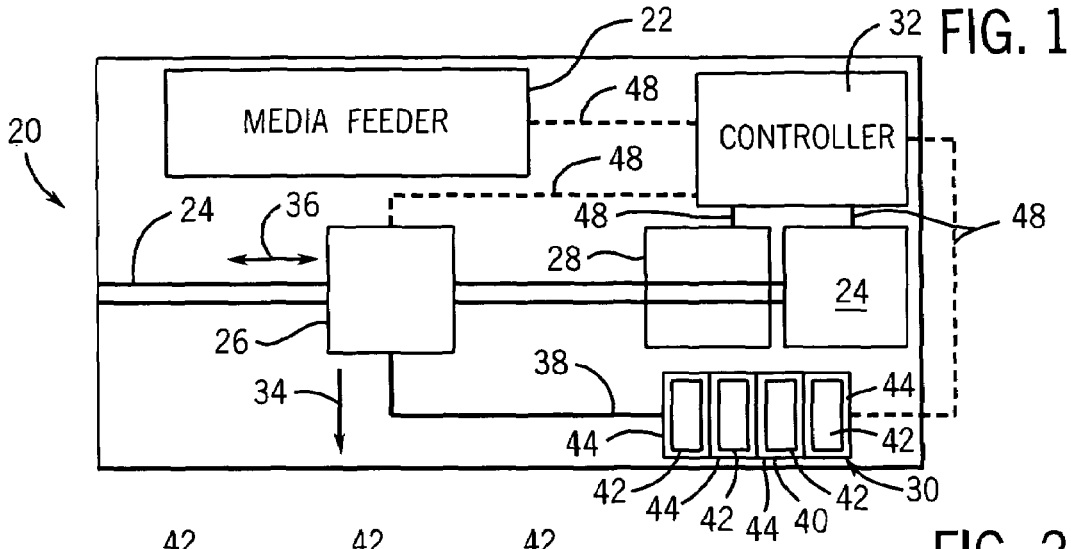
FIG. 1 schematically illustrates one example of a printer incorporating one example of an ink supply system of the present invention.

FIG. 1 schematically illustrates printer 20 which generally includes media feeder 22, carriage 24, pens 26, service station 28, ink supply system 30 and controller 32. Media feeder 22 comprises a conventionally known or future developed drive configured to move a medium, such as paper, relative to pens 26. Pens 26 may also be referred to as print cartridges. Carriage 24 comprises a conventionally known or future developed carriage configured to move pens

26 relative to the medium being supplied and moved by feeder 22. In the particular embodiment illustrated, media feeder 22 moves paper in the direction indicated by arrow 34 while carriage 24 moves pens 26 in the directions indicated by arrows 36. Service station 28 comprises a conventionally known or future developed printer station including devices configured to perform servicing operations upon pens 26 between printing operations. Examples of such service operations include wiping and capping.

Ink supply system 30 supplies fluid ink to pens 26 through tubing 38. Ink supply system 30 generally includes ink supply station 40 and ink supplies 42. As will be described in greater detail hereafter, ink supply station 40 is formed from a plurality of distinct modules 44 releasably coupled to one another. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. In one embodiment, modules 44 are directly coupled or connected to one another. In another embodiment, modules 44 are indirectly coupled to one another by means of an intermediate framework.

Each module 44 includes one or more of the components that are generally necessary per each ink supply 42. In other words, those components or devices which must be individually provided for each ink supply 42 are singulated or separated and provided by each module 44. In contrast, one or more of the components or devices which are commonly shared or used by all of ink supplies 42 are generally provided only once, eliminating redundancy. As a result, ink supply station 40 may be easily reconfigured to accommodate varying numbers of ink supplies 42 by adding or removing individual modules 44 to ink supply station 40.

Controller 32 generally comprises a processor unit configured to generate control signals which are transmitted to media feeder 22, carriage 24, pens 26, service station 28 and ink supply system 30 as indicated by communication lines 48. For purposes of this disclosure, the term "processor unit" shall mean a conventionally known or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. Controller 32 is not limited to any specific combination of hardware circuitry and software, nor to any particular source for the instructions executed by the processing unit.

Although ink supply system 30 is illustrated in conjunction with printer 20 having pens 26 which are moved or scanned across the medium, ink supply system 30 may alternatively be employed in printers having pens in which the pens are held stationary as the medium is moved relative to the pens. One example of such a printer is a page-wide array printer. In particular applications, ink supply system may be utilized with other image-forming devices wherein fluid ink is deposited upon a medium by means other than pens or printheads or wherein the medium itself is held generally stationary as the ink is deposited upon the medium. Overall, ink supply system 30 may be utilized in any image-forming device which utilizes ink.

Figure 2:
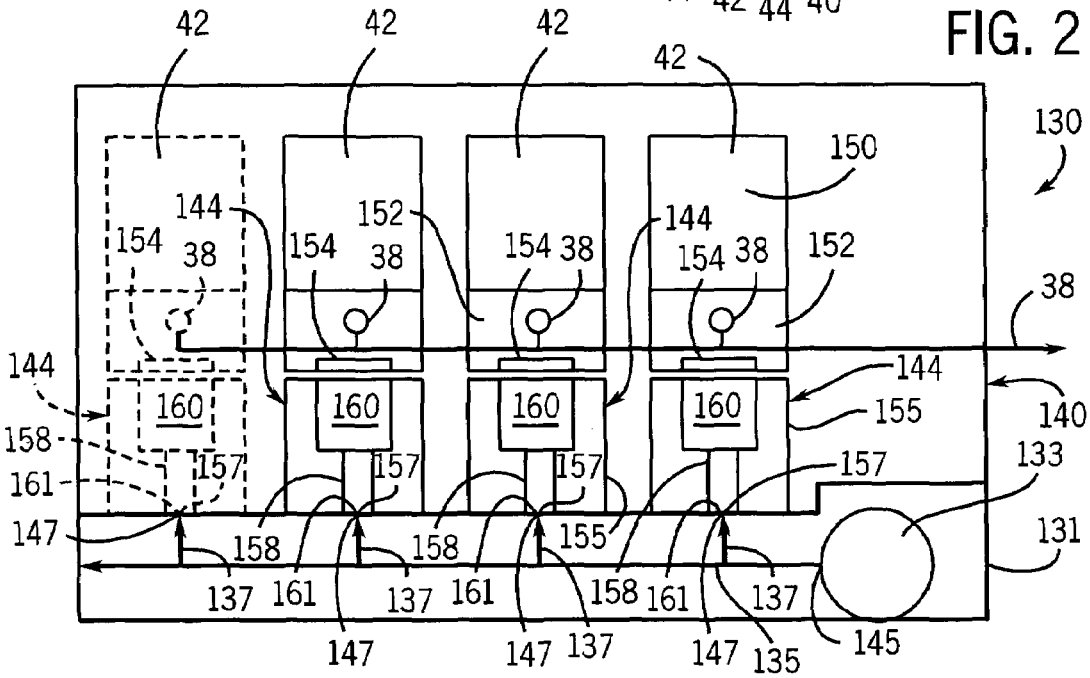
FIG. 2 schematically illustrates a first alternative embodiment of the ink supply system of FIG. 1.

FIG. 2 illustrates ink supply system 130, an example of one embodiment of ink supply system 30. Ink supply system 130 generally includes support frame 131, power source 133, power transmission 135 having output portions 137, ink supplies 42 and ink supply station modules 144. Support frame 131 generally comprises a structure or housing which joins and supports power source 133 and transmission 135. Support frame 131 further removably receives and supports modules 144 and ink supplies 42. Although not illustrated, frame 131 may also support conventionally known acumen connectors for each ink supply 42.

Power source 133 comprises a conventionally known or future developed device configured to provide power such as torque, fluid or pneumatic pressure, or electrical power for driving each of modules 144. Power source 133 supplies power to transmission 135 via output portion 145.

Transmission 135 transmits the power from power source 133 to each of modules 144. Output portions 137 generally include couplings 147 configured to releasably interlock or releasably mate with corresponding couplings associated with each of modules 144.

Ink supplies 42 comprise conventionally known or future developed ink supplies fluidly coupled to pens 26. For purposes of this disclosure, the terms "fluidly coupled" or "in fluid communication" means that two or more members having fluid containing volumes that are connected to one another by one or more fluid passages enabling fluid to flow between the volumes in one or both directions. Such fluid flow may be temporarily cessated by selective actuation of valve devices. In the embodiment illustrated, ink supplies 42 are configured to supply fluid ink through a plurality to tubes 38 to pens 26 (shown in FIG. 1). Each ink supply 42 generally includes an ink reservoir 150, a fluid passage 152 extending from reservoir 150 to tube 38 and a flexible diaphragm 154 (sometimes known as a bongo). Movement of diaphragm 154 pressurizes fluid ink along passage 152 to move the ink through tube 38 to pens 26. Fluid passage 152 may be temporarily occluded at points between reservoir 150 and pens 26 during the supply of ink to pens 26. Examples of an ink supply 42 are disclosed in U.S. Pat. No. 5,971,529 entitled "Automatic Ink Interconnect Between Print Cartridge and Carriage" and U.S. Pat. No. 5,966,155 entitled "Inkjet Printing System With Off-Axis Ink Supply Having An Ink Path Which Does Not Extend Above Print Cartridge," the full disclosures of which are hereby incorporated by reference.

Modules 144 comprise distinct individual units configured to be releasably mounted to frame 131 and further configured to interact with diaphragms 154 to pressurize ink and move ink through tubes 38. Each module 144 generally includes a body, frame or chassis 155, a power transmission input portion 157, drive mechanism 158 and a pressurization system 160. Chassis 155 generally comprises a structure or framework supporting the remaining components of module 144. Chassis 144 may have a variety of different sizes, shapes and configurations depending upon the exact characteristics of module 144. Power transmission input portion 157 generally comprises a coupling 161 configured to releasably interlock or releasably mate with coupling 147 of output portion 137 so as to transmit power from transmission 135 to drive mechanism 158.

Drive mechanism 158 generally comprises a structure configured to convert the power or energy supplied to it through transmission 135 and coupling 161 into a force by which pressurization system 160 interacts with diaphragm 154 to move diaphragm 154. The actual configuration of drive mechanism 158 may vary depending upon the form of the energy or power being provided to drive mechanism 158. For example, drive mechanism 158 may comprise a cam wherein the power is in the form of mechanical torque, a piston wherein the power is in the form of a pressurized gas or fluid or a solenoid or other electrically driven device wherein the power is in the form of electrical power.

Pressurization system 160 comprises a mechanical device configured to be driven by drive mechanism 158 to interact with diaphragm 154 so as to move diaphragm 154. Pressurization system 160 includes a movable member supported by module 144 so as to move while in engagement with diaphragm 154 to move diaphragm 154.

In one embodiment, power source 133 may comprise a motor configured to generate rotational mechanical energy or torque which is transmitted by transmission 135, comprising a power train, to each of force couplings 147 which mate with force couplings 161. Drive mechanism 158 may comprise a cam which is rotatably driven by the rotational mechanical energy to move the movable member of pressurization system 160 while the movable member is in engagement with flexible membrane 154.

In another embodiment, power source 133 may comprise a hydraulic or pneumatic pump, wherein transmission 135 comprises a pneumatic or fluid conduit. Couplings 147 and 161 may be configured to transmit pneumatic or fluid pressure from source 133 to drive mechanism 158 comprising a piston, wherein pressurization system 160 includes a movable member coupled to the piston. Supply of pressurized gas or fluid against the piston moves the movable member while the movable member is in engagement with the diaphragm 154.

In yet another alternative embodiment, power source 133 may comprise a source of electrical power, wherein transmission 135 comprises an electrical power transmitting line. In such an embodiment, couplings 147 and 161 are configured to provide electrical interconnection between transmission 135 and each of modules 144. Electrical power transmitted to each of modules 144 is supplied to drive mechanism 158 comprising a solenoid. The supply of electrical power to the solenoid causes the solenoid to move the movable member of pressurization system 160 while in engagement with the diaphragm 154.

As illustrated by the module 144 and ink supply 42 shown in phantom in FIG. 2, ink supply station 140 may be easily reconfigured to accommodate a varying number of ink supplies 42. In particular, to add an additional ink supply, an additional module 144 may be releasably coupled to frame 131 with power transmission input portion 157 coupled to power transmission output portion 137. In particular applications, frame 131 may also need to be reconfigured to provide additional power output portions 137. Even if frame 131 also needs to be reconfigured, system 130 enables the same modules 144 to be employed. As a result, ink supply station 140 provides ink supply system 130 with improved versatility.

Figure 3:
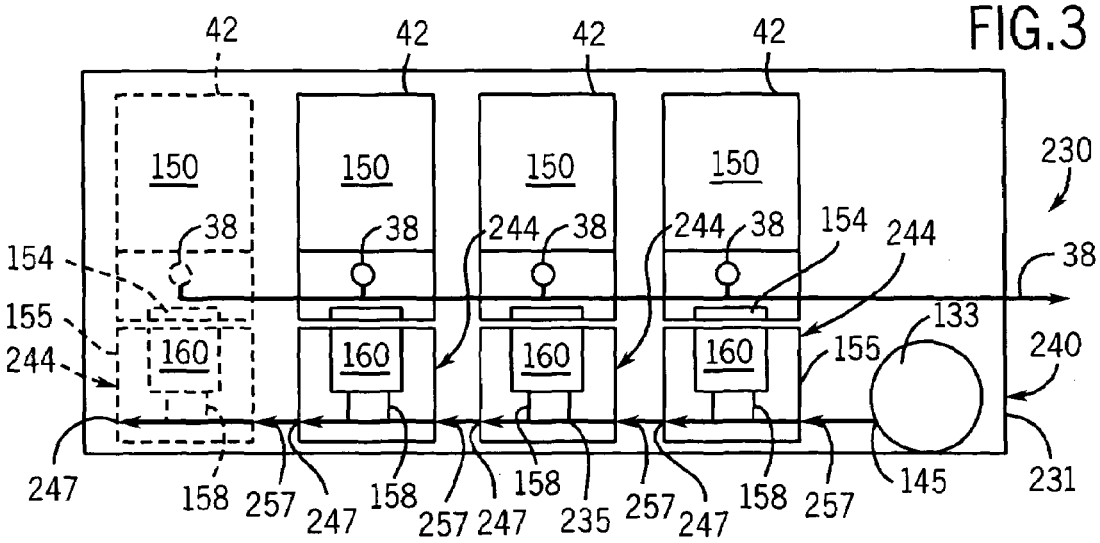
FIG. 3 schematically illustrates a second alternative embodiment of the ink supply system of FIG. 1.

FIG. 3 schematically illustrates ink supply system 230, an alternative embodiment of ink supply system 130. Ink supply system 230 is similar to ink supply system 130 except that ink supply system 230 includes ink supply station 240 having modules 244 in lieu of modules 144. For ease of illustration, those remaining elements of ink supply system 230 which correspond to elements of ink supply system 130 are numbered similarly. Each of modules 244 generally includes transmission input portion 257, power transmission output portion 247 and pressurization system 160. Power transmission input portion 257 comprises a structure configured to facilitate the input of power to module 244. Power transmission output portion 247 is operably coupled to one or both of input portion 257 and pressurization system 160 and is configured to output power from module 244. As a result, modules 244, themselves, provide at least a portion of the transmission for transmitting power from power source 133 to each of pressurization systems 160 and to adjacent modules 244. In one embodiment, power transmission output portion 247 is configured to be releasably connected to a power transmission input portion 257 of an adjacent module 244.

As shown by FIG. 3, power transmission input portion 257 of an endmost module 244 is releasably coupled to power source 133. In alternative embodiments, this endmost module 244 may be permanently secured to power source 133. The opposite endmost module 244 is illustrated as including an unconnected power transmission output portion 247. In particular embodiments, this module may be configured so as to omit the power transmission output portion 247.

In one particular embodiment, ink supply station 240 includes a frame 231 to which modules 244 are releasably coupled. Modules 244 may additionally include mating structures configured to locate modules 244 adjacent to one another. In yet an alternative embodiment, ink supply station 240 may omit frame 231, wherein modules 244 are releasably connected to one another to form a single overall unit configured to receive or be releasably connected to ink supplies 42.

As shown by the module 244 and its ink supply 42 illustrated with phantom lines, ink supply station 240 may be easily reconfigured to accommodate varying numbers of ink supplies 42. In particular, adding an ink supply requires that an additional module 244 be releasably coupled to either an adjacent module 244 or to a frame 231 (if provided). In particular applications, an alternative frame 231 providing additional locations for additional modules 244 may be required. In still other embodiments, frame 231 may be configured to be releasably coupled to a frame extension which provides additional locations for additional modules 244.

Because the overall transmission 235 extending from power source 133 to pressurization systems 160 is in part provided by modules 244 themselves, frame 231 may be omitted or may be provided with a much reduced complexity as compared to frame 131. Modules 244 may be connected directly to one another to provide a single power transmission between each of pressurization systems 160 from a single power source 133.

In one embodiment, power source 133 comprises a motor configured to generate rotational mechanical energy or torque. Transmission 135 comprises a power train formed by gears and shafts provided in each of modules 244. Pressurization system 160 comprises a movable member in engagement with flexible diaphragm 154 and a drive mechanism 158, such as a cam, which is driven by the rotational mechanical energy from power source 133.

In another embodiment, power source 133 may comprise a source of pressurized gas or fluid such as a pneumatic or hydraulic pump. Transmission 235 comprises a pneumatic or hydraulic conduit, wherein input portion 257 and output portion 247 comprise pneumatic or hydraulic couplings. Drive mechanism 158 comprises a piston. Pressurization system 160 includes a movable member coupled to the piston and in engagement with flexible diaphragm 154.

In still another embodiment, power source 133 comprises a source of electrical power and transmission 235 comprises an electrically conductive line. Input portion 257 and output portion 247 comprise electrical connectors. Drive mechanism 158 comprises a solenoid. Pressurization system 160 includes a movable member coupled to the solenoid and in engagement with flexible diaphragm 154.

FIGS. 4–16 illustrate printer 320, a detailed embodiment of printer 20 shown in FIG. 1. For purposes of illustration, portions of printer 320 are omitted. Printer 320 includes media feeder 322, carriage 324, pens 326, service station 328 and ink supply system 330. Media feeder 22 comprises a drive configured to move a medium, such as paper, relative to carriage 324 and pens 326. Carriage 324 comprises a device configured to move pens 326 relative to the medium being supplied and moved by feeder 322. In the particular embodiment illustrated, carriage 324 includes a belt or cable 329 which is driven to move pens 326. Service station 328 performs servicing operations upon pens 26 between printing operations.

Ink supply system 330 includes ink supply station 340 and a plurality of ink supplies 342 (one of which is shown). An example embodiment of ink supplies 342 are shown and described in U.S. Pat. No. 5,971,529, the full disclosure of which is hereby incorporated by reference. Ink supply 42 includes a flexible diaphragm 154 (schematically shown in FIG. 3) by which fluid ink contained within a fluid passage is pressurized. Ink supply station 340 provides a structure for supporting and at least partially housing ink supplies 342 and for delivering ink from ink supplies 342 to pens 326 through tubing 38 (shown in FIG. 1). In the particular embodiment illustrated, each ink supply 342 has an individual tube 38 connected to a dedicated pen 326.

Figure 8:
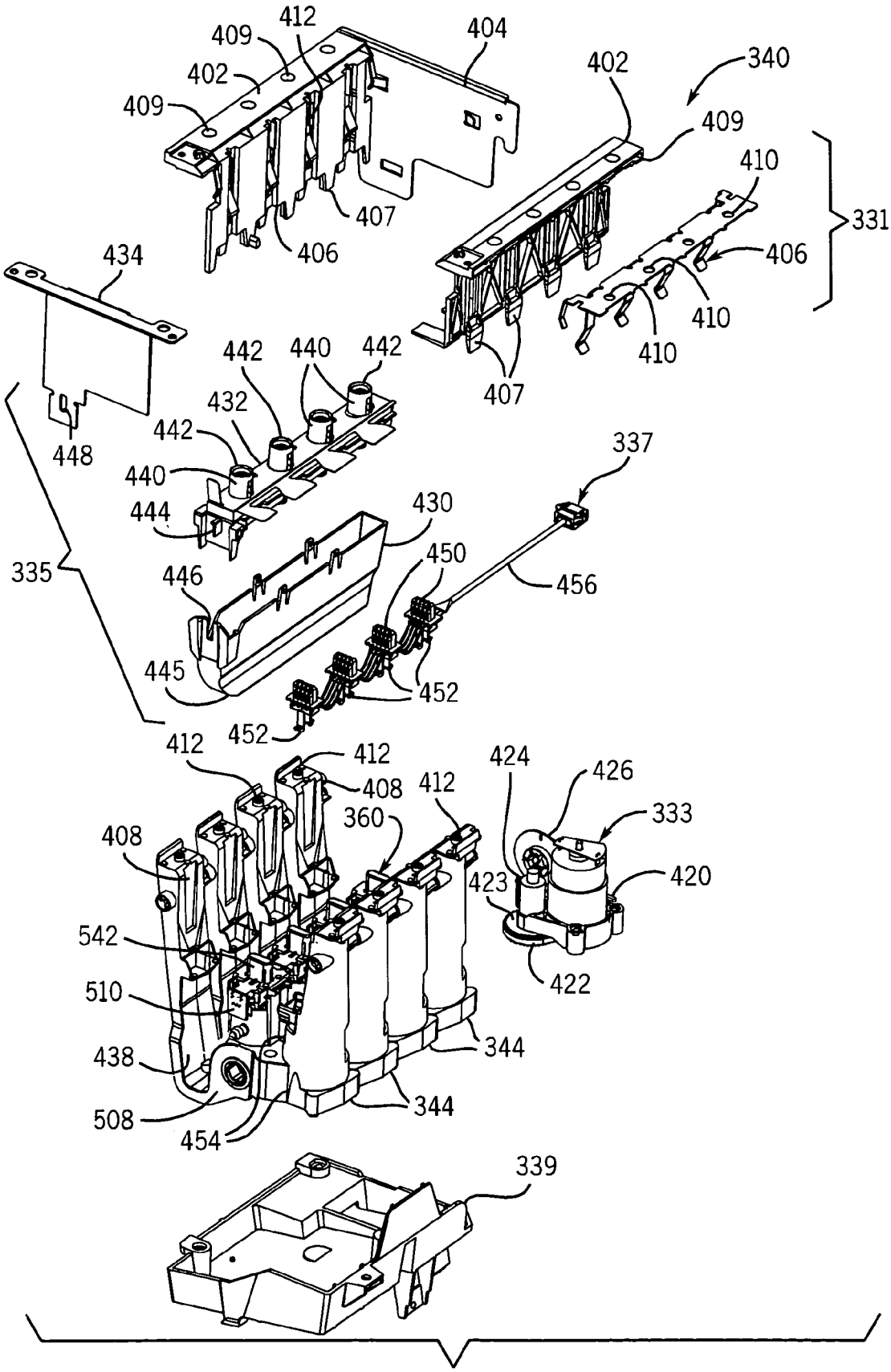
FIG. 8 is an exploded perspective view of the ink supply station of the printer of FIG. 4.

FIGS. 5–8 illustrate ink supply station 340 in greater detail. As shown by FIG. 8, ink supply station 340 generally includes support frame 331, motor assembly 333, ink delivery system 335, acumen connector assembly 337, bottom plate 339 and modules 344. Support frame 331 comprises a structure configured to support modules 344 in position relative to one another. Support frame 331 also is configured to align and position ink supplies 342 (shown in FIG. 4) within station 340. In the particular embodiment illustrated, support frame 331 includes key walls 402, end plate 404 and springs 406. Key walls 402 support spring 406 and are interconnected to one another by end plate 404. Springs 406 pass through bores 412 within key walls 402 so as to resiliently engage ink supplies 42. Springs 406 assist in aligning and securing ink supplies 42 within station 340.

Key walls 402 include downwardly projecting tabs 407 which mate with corresponding slots 408 provided on modules 344 to secure modules 344 relative to one another. Key walls 402 additionally include apertures 409 through which fasteners extend into aligned apertures 410 in springs 406 and into aligned bores 412 provided on modules 344.

In alternative embodiments, key walls 402 may be coupled to one another by means other than plate 404. Springs 406 may be secured to key walls 402 by means other than fasteners. In particular embodiments, key walls 402 and springs 406 may be integrally formed as part of a single unitary body. In alternative embodiments, support frame 331 may include other structures or components which releasably secure modules 344 relative to one another. Although springs 406 are illustrated as being supported by key walls 402, springs 406 may alternatively be reconfigured and provided by each of modules 344. In still other embodiments, support frame 331 may be omitted wherein modules 344 are directly coupled and releasably fastened to one another.

Motor assembly 333 (also known as a power train assembly) is coupled to an end-most one of modules 344. In alternative embodiments, motor assembly 333 may alternatively be supported by an alternatively configured support frame 331. Motor assembly 333 comprises a power source configured to provide rotational mechanical energy or torque to a drive train provided by the interconnection of modules 344. Motor assembly 333 generally includes motor 420, toothed belt 422, gear 423, worm gear 424, encoder wheel 426 and a optical sensor 428 (shown in FIG. 6). Motor 420 comprises an electric motor having an output shaft which rotatably drives toothed belt 422 coupled to gear 423. Worm gear 424 is coupled to gear 423 and functions as a mechanical power transmission output portion of assembly 333, Worm gear 424 engages a mechanical power transmission input portion of one of modules 344 to transmit torque from motor 420. Worm 421 further rotatably drives encoder wheel 426. Encoder wheel 426 rotates and passes between a photo emitter and a photo receiver of an optical sensor 428 (shown in FIG. 6) to generate signals which are transmitted to a controller 32 (shown in FIG. 1) to assist in controlling motor 420. In alternative embodiments, encoder wheel 426 and the optical sensor 428 may be omitted wherein motor 420 alternatively comprises a stepper motor. In lieu of belt 422 and worm gear 424, alternative mechanical torque transmission components may be utilized such as intermeshing gears, chain and sprocket assemblies or other belt and pulley arrangements.

Ink delivery system 335 generally comprises one or more structures configured to deliver ink from ink supplies 342. System 335 includes housing 430, port assembly 432 and end plate 434. Housing 430 provides a structure in which tubes 38 are contained and are connected to port assembly 432. Housing 430 includes a bottom opening 445 through which tubes 38 pass into channel 438 and extend to pens 326. Housing 430 is partially received within channel 438 of each of modules 344.

Figure 4:
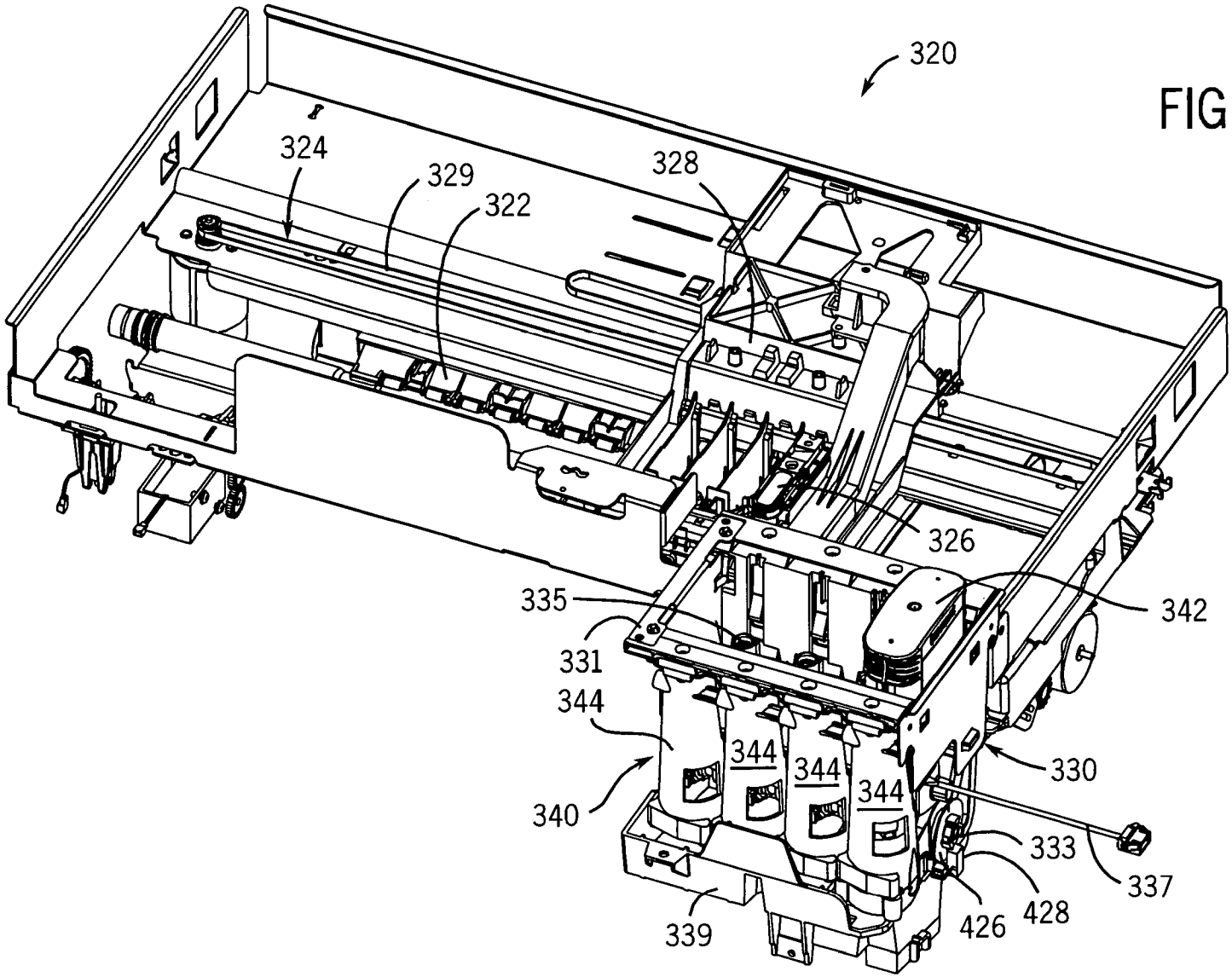
FIG. 4 is a top perspective view of one example of one embodiment of the printer shown in FIG. 1.
Figure 7:
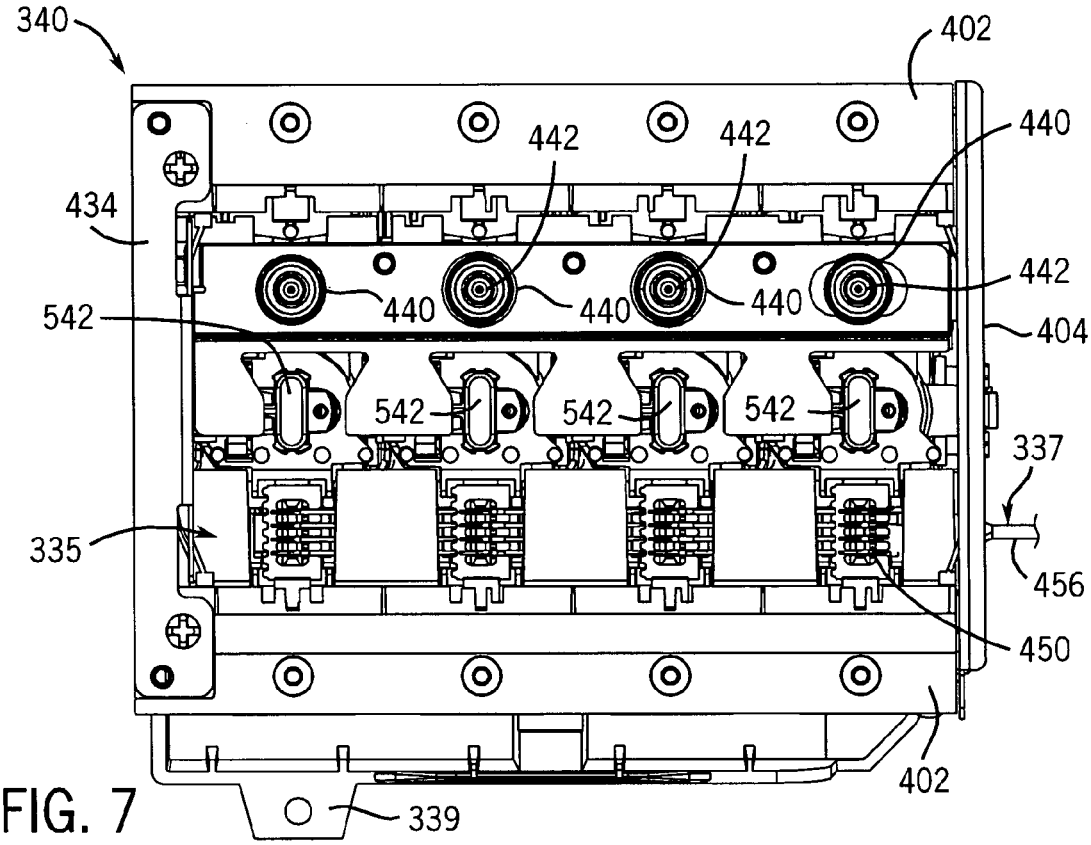
FIG. 7 is a top plan view of the ink supply station of the printer of FIG. 4.

Port assembly 432 provides a fluidic interconnection to each of ink supplies 342 (shown in FIG. 4). Port assembly 432 includes a plurality of alignment structures 440 and needles 442. Alignment structures 440 align and mate needles 442 to corresponding septums provided on ink supplies 342. Needles 442 are in fluid communication with tubes 438.

End plate 434 is fixedly coupled to housing 430 and port assembly 432 by means of tab 444 which projects through openings 446 and opening 448. End plate 434 is configured to be secured to key walls 402 of support frame 331.

Although ink distribution system 335 is illustrated as including the individual components shown which are coupled to one another, ink supply system 335 may alternatively be provided by a greater or fewer number of components or may utilize other conventionally known or future developed means for providing a fluidic interconnection to each of ink supplies 342.

Acumen connector assembly 337 is conventionally known and is configured to connect to the acumen or memory of each individual ink supply 42. In the particular embodiment, acumen connector assembly 337 includes individual acumen connectors 450 having prongs 452 which snap into place between support legs 454 on each of modules 344. Acumen connector assembly 337 includes a communication cable 456 configured to connect to and communicate with controller 32 (shown in FIG. 1).

Bottom plate 339 comprises a structure configured to be releasably mounted to a lower surface of modules 344. Bottom plate 339 further secures modules 344 relative to one another. In addition, bottom plate 339 serves as structure for releasably mounting ink supply station 340 to the remainder of printer 320.

Modules 344 comprise distinct units releasably coupled to one another and configured to interact with ink supplies 42 to pressurize and pump fluid ink from ink supplies 42. In the particular embodiment illustrated, each of modules 344 is substantially identical to one another. In alternative embodiments, modules 344 may have varying configurations. For example, in one alternative embodiment, one module 344 may be configured to interact with a first type of ink supply while another module 344 is configured to interact with a second type of ink supply.

Figure 9:
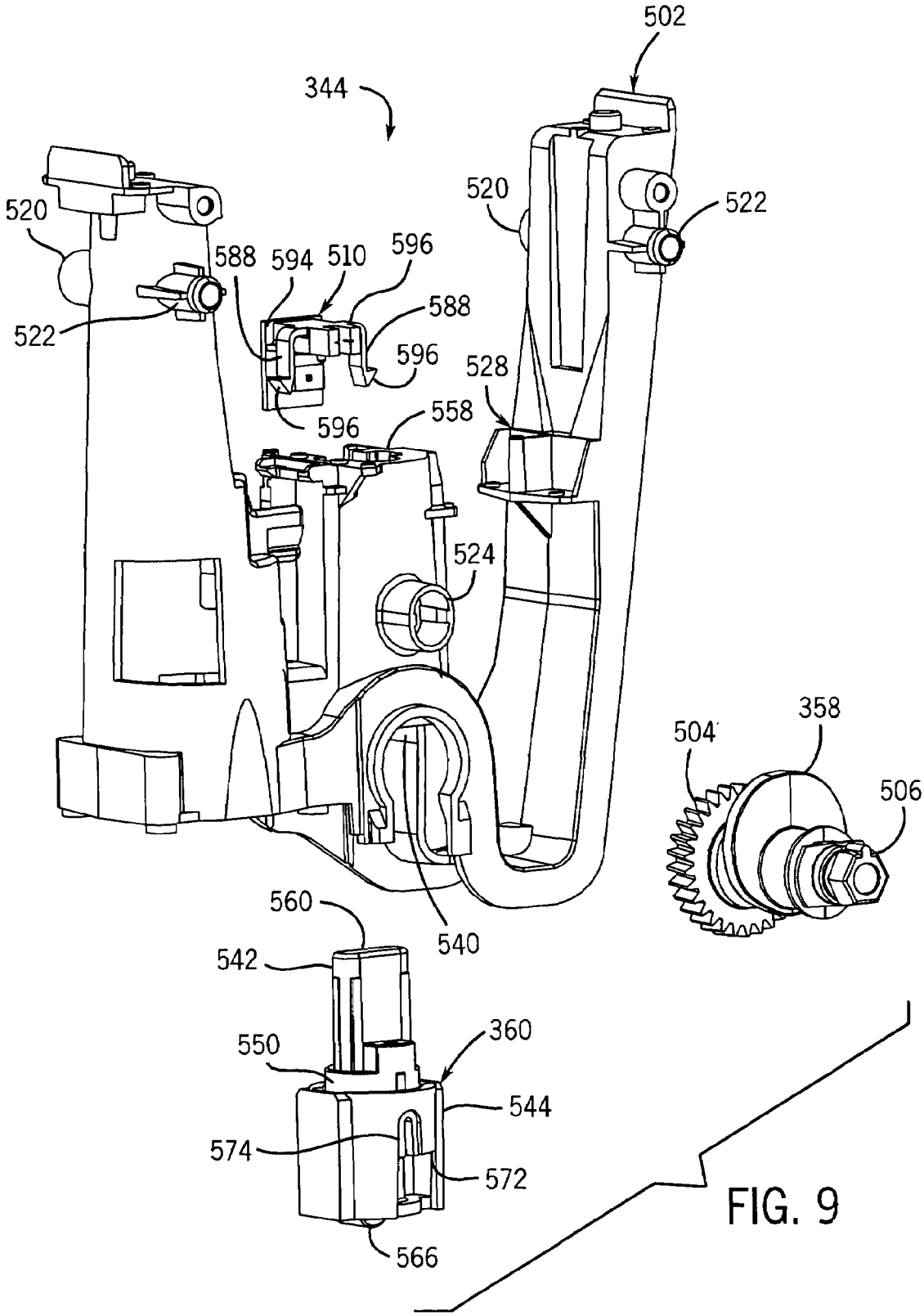
FIG. 9 is a rear exploded perspective view of a single module of the ink supply station of the printer of FIG. 4.
Figure 11:
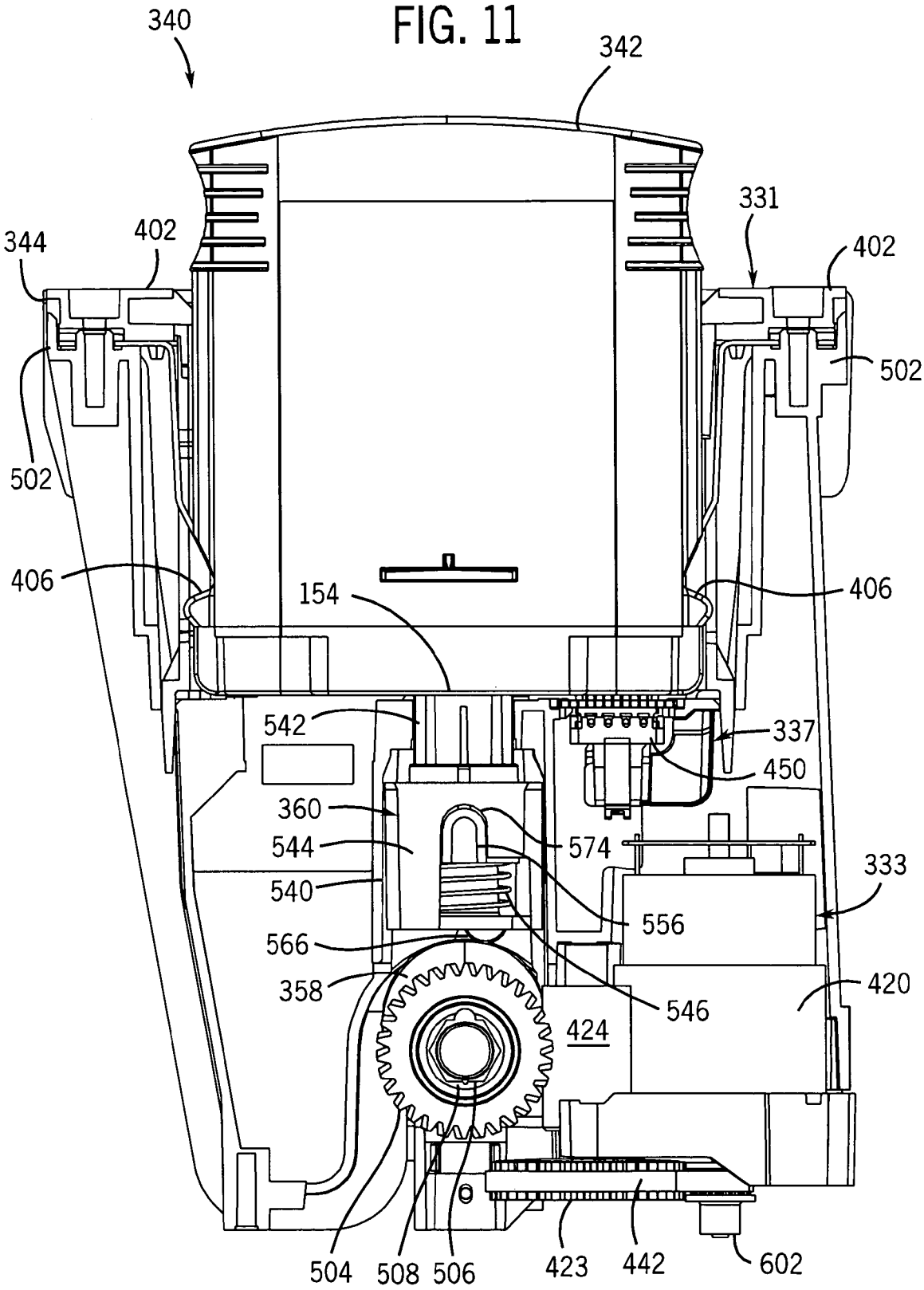
FIG. 11 is a fragmentary side elevational view of an ink supply system of the printer of FIG. 4.

FIGS. 9–14 illustrate one of modules 344 in greater detail. As best shown by FIG. 9, module 344 generally includes chassis 502, mechanical power transmission input portion 504, mechanical power transmission input portion 506, mechanical power transmission output portion 508 (shown in FIG. 10) drive mechanism 358, pressurization system 360 and sensor 510. Chassis 502 is a structure configured to support and carry the remaining components of module 344. In the particular embodiment illustrated, chassis 502 is also configured to locate module 344 relative to frame 331, to locate module 344 relative to adjacent modules 344 and to locate an ink supply 342 relative to ink supply station 340. In alternative embodiments such additional functions may be provided by other structures.

In addition to slots 408, bores 412 and channel 438 described above, chassis 502 includes module locators 520, 522, 524, 526, and ink supply locations or datums 528. Locators 520 and 522 extend on opposite sides of chassis 502. Locators 520 and 522 are configured to mate with opposite extending locators on adjacent modules. In the particular embodiment illustrated in which modules 344 are substantially identical to one another, locators 520 are configured to mate with locators 522. Locators 524 and 526 extend on opposite sides of chassis 502 and are configured to mate with opposite locators provided on adjacent modules 344. In the particular embodiment illustrated in which modules 344 of ink supply station 340 are substantially identical to one another, locator 526 is configured to mate with locator 524. Overall, locators 520, 522, 524 and 526 facilitates proper alignment of chassis 502 of adjacent modules 344.

Ink supply datums 528 generally comprise surfaces provided by chassis 502 which are located so as to engage or abut a lowermost floor surface of an ink supply 342. Datums 528 serve as reference locations for sensor 510 in detecting the movement and position of pressurization system 360 relative to the flexible membrane or bongo of the fluid ink supply 342. The exact number and location of datums 528 may be varied depending upon the type of ink supply.

Mechanical power transmission input portion 504 comprises a helical gear immovably coupled to drive mechanism 508. Input portion 504 is configured to intermesh with worm gear 424 of motor assembly 333 (shown in FIGS. 8 and 11). In alternative embodiments, input portion 504 may comprise other forms of a gear or other conventionally known or future developed transmission components or component. For example, portion 504 may alternatively comprise a pinion gear in intermeshing engagement with a corresponding pinion or spur gear associated with motor assembly 333.

Mechanical power transmission input portion 506 comprises a transmission component immovably coupled to drive mechanism 358 configured to interact with a corresponding mechanical power transmission output portion of an adjacent module 344. In the particular embodiment illustrated in which modules 344 of ink supply station 340 are substantially identical to one another, input portion 506 is configured to mate with mechanical power transmission output portion 508.

Mechanical power transmission output portion 508 (shown in FIGS. 10 and 10A) comprises a structure configured to mate with a mechanical power transmission input portion of an adjacent module 344 so as to permit the transmission of mechanical power or torque between adjacent modules 340. In the particular module illustrated, mechanical power transmission input portion 506 comprises a hexagonal shaft while mechanical power transmission input portion comprises a hexagonal bore. In alternative embodiments, input portion 506 and output portion 508 may alternatively comprise a bore and shaft, respectively. In lieu of input portion 508 receiving output portion 506, output portion 506 and input portion 508 may alternatively extend side by side or end to end during inter-engagement and mating. For example, in one embodiment, input portion 506 and output portion 508 may alternatively comprise intermeshing teeth of adjacent gears. These and various other mating or otherwise inter-engaging arrangements so as to transmit torque are contemplated.

Drive mechanism 358 comprises a cam immovably coupled to input portions 504 and 506. Drive mechanism 358 is rotatably supported by chassis 502 so as to interact and engage pressurization system 360. In the particular embodiment illustrated, drive mechanism 358, input portions 504, 506 and output portion 508 are all integrally formed as part of a single unitary body. As a result, manufacturing costs of module 344 are reduced. In alternatively embodiments, input portions 504, 506, output portion 508 and drive mechanism 358 may be provided by separate components fixedly or immovably coupled to one another.

In the particular embodiment illustrated, each module 344 is provided with input portion 504 and output portion 508. Because each module includes input portion 504 and output portion 508, each module 344 is completely interchangeable with one another regardless of whether the particular module 344 is an end-most module of the series of modules forming ink supply station 340. In alternative embodiments, an end most one of modules 344 and ink supply station 340 may omit output portion 508. Alternatively, only the end most module 344 directly coupled to motor assembly 333 need include input portion 504.

Pressurization system 360 is operably coupled between drive mechanism 358 and the flexible diaphragm 154 (shown in FIG. 3) of ink supply 42. Pressurization system 360 is slidably disposed within an interior cavity 540 formed in chassis 502. As best shown by FIG. 12, pressurization system 360 includes movable member 542, base member 544 and compression spring 546. Movable member 542 (also known as a lifter) includes hub 550, extension 552, flag 554 and projections 556. Hub 550 includes a hollow interior configured to receive an upper end of spring 546. Hub 550 is slidably received within base member 544. Extension 552 extends from hub 550 and is configured to pass through opening 558 of chassis 502. Extension 552 includes membrane engagement surface 560 which bears against a lower surface of flexible membrane 154 of an ink supply 42. Flag 554 projects from extension 552 and is configured to cooperate with sensor 510 to facilitate the detection of movement of movable member 542. Projections 556 projects outwardly from hub 550 and interacts with base member 544 to releasably secure movable member 542 to base member 544.

Base member 544 (sometimes referred to as a plunger) cooperates with movable member 542 to capture spring 546 therebetween and also guides movement of movable member 542. Base member 544 includes floor 562, peripheral wall 564 and drive mechanism engagement surface 566. Floor 562 and wall 564 form an interior bore 568 sized to slidably receive hub 550 and also configured to capture spring 546 between movable member 542 and base member 544. Wall 564 further includes an elongate grooves 570, peripheral slot 572 and peripheral notches 574. Grooves 570 extend opposite one another and slidably receive projections 556. Grooves 570 communicate with peripheral slot 572. Peripheral slot 572 extends along the periphery of wall 564 and communicates with notches 574. Notches 574 generally extends along the central axis of extension 552 and are sized to slidably receive projections 556.

Pressurization system 360 is assembled by moving projections 556 through grooves 570 until projections 556 are across from peripheral slot 572. Movable member 542 is then rotated approximately 90 degrees within slot 572 until projections 556 are within notches 574. As a result, spring 546 is captured between movable member 542 and base member 544. Movable member 542 moves along axis 576 (shown in FIG. 12) while notches 574 engage projections 556 to guide movement of movable member 542. The resulting assembly forms a spring-loaded plunger.

Engagement surface 566 generally extends along a lower surface of floor 562 and is configured to engage drive mechanism 358. Rotation of drive mechanism 358 moves base member 544 along axis 576 to compress spring 546 against movable member 542. As a result, movable member 542 moves along axis 576 while in engagement with diaphragm 154 of ink supply 42.

Overall, pressurization system 360 provides module 344 with a compact, low-cost, easily assembled mechanical assembly which reciprocates while in engagement with diaphragm 154 of ink supply 42 to pressurize fluid ink. In contrast to prior systems employing a rocker arm and a torsion spring connected to the rocker arm and to a chassis, pressurization system 360 provides extremely low stresses and minimizes the number of parts that are loaded by the spring. The resulting lower part stresses reduces part creepage or breakage. By minimizing the number of loaded parts in both pressurized and de-pressurized positions, pressurization system 360 improves reliability.

Sensor 510 is directly coupled to chassis 502 and is configured to detect or sense the movement or position of movable member 542 relative to the floor of ink supply 42 or its flexible membrane 154. Sensor 510 is located relative to chassis 502 by sensor locator surfaces 580 (shown in FIG. 14). Sensor locator surfaces 580 are precisely positioned to locate sensor 510 relative to ink supply locator surfaces 528. In the particular embodiment illustrated, chassis 502 which provides both locator surfaces 528 and 580 is integrally formed as part of a single unitary body. As a result, the extent of potential dimensional variations of components between sensor 510 and ink supply locating surfaces or datums 528 (also known as tolerance stack) is reduced. In the particular embodiment illustrated, sensor locator surface 580 and ink supply locator surfaces 528 are formed from a common side of a common mold such that the part line of the mold extends to one side of both surfaces 580 and 528. As a result, dimensional variation resulting in varying distances between sensor 510 and ink supply locator surfaces 528 during molding is further reduced. By reducing such dimensional variations or the tolerance stack, a more accurate detection of the movement and position of movable member 542 relative to ink supply locator surfaces 528 and the floor or membrane 154 of ink supply 42 is achieved. Such accurate sensing of the position of movable member 542 is achieved without requiring individual adjustment of sensor 510 or of pressurization system 360.

As best shown by FIGS. 9 and 10A, sensor 510 generally includes body 584, sensing mechanism 586 and prongs 588. Body 584 comprises a housing about sensing mechanism 586. Sensing mechanism 586 senses movement of movable member 542. In the particular embodiment illustrated, sensing mechanism 586 comprises a photo or optical detector generally including a light emitter 590, a light receiver or detector 592 (schematically shown) and printed circuit assembly 594. Light emitter 590, light receiver 592 and printed circuit assembly 594 are conventionally known. Light emitter 590 and light receiver 592 are spaced from one another on opposite sides of an opening 596 formed within housing 584. Opening 596 receives flag 554 of movable member 542. Flag 554 interrupts the light passing from emitter 590 to receiver 592. As a result, detector mechanism 586 senses movement of movable member 542 and its position in a conventionally known manner. A wiring harness (not shown) is connected to each of printed circuit assemblies 594 of sensors 510 and is further connected to controller 32 (shown in FIG. 1).

Prongs 588 extend from body 584 and terminate at hooks 596. As best shown by FIG. 14, prongs 588 pass through corresponding slots within chassis 502. During connection of sensor 510 to chassis 502, prongs 588 resiliently flex towards one another to enable hooks 596 to pass below sensor locator surfaces 580. Due to their tapered nature, prongs 588 engage chassis 502 to urge hooks 596 upwardly against sensor locator surfaces 580. As a result, prongs 588 and hooks 596 ensure proper and consistent positioning of sensor 510 relative to chassis 502 which serves as a mounting structure for sensor 510. The consistent positioning of sensor 510 relative to chassis 502 without requiring adjustment reduces assembly cost and facilitates more reliable and accurate position sensing of movable member 542.

Figure 16:
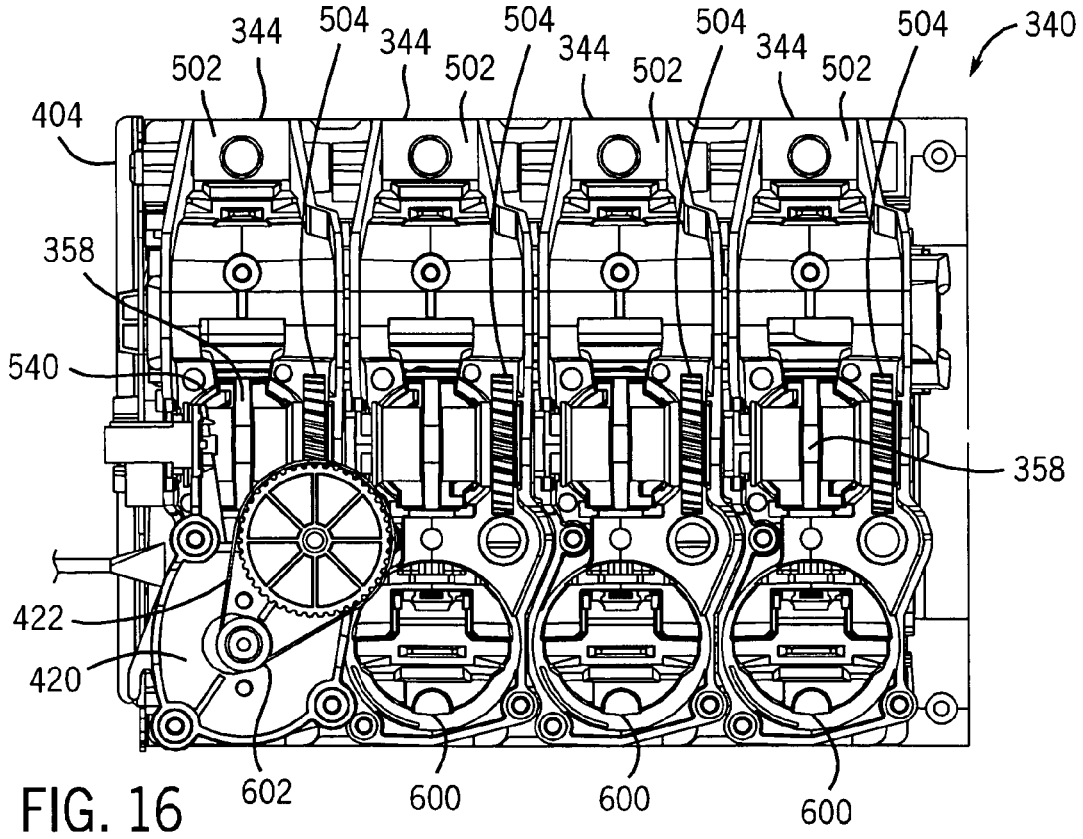
FIG. 16 is a bottom plan view of the ink supply station of FIG. 6 with a bottom plate omitted for purposes of illustration.
Figure 15:
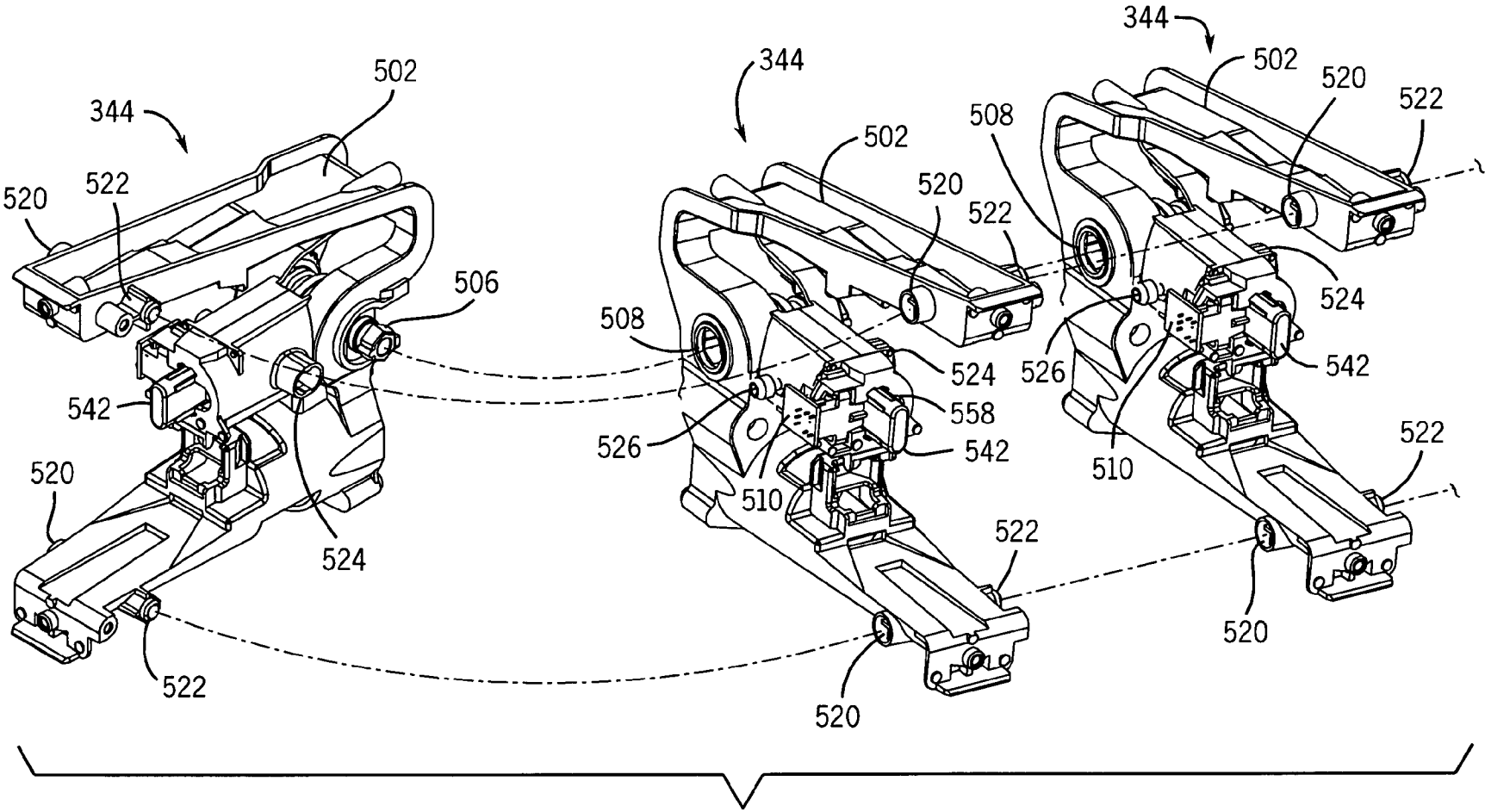
FIG. 15 is a top perspective view of the plurality of modules.

FIGS. 15 and 16 illustrate the interconnection of multiple modules 344. As best shown by FIG. 15, modules 344 are positioned relative to one another by aligning locators 520 with locators 522 and by aligning locators 524 with opposite locators 526. Interconnection of modules 344 also results in input portions 506 mating with opposite output portions 508 to form a continuous transmission or drive train through modules 344 for rotating each of drive mechanisms 358 to move each of movable members 542. In particular, as best shown by FIG. 16, motor 420 which is mounted within mounting aperture 600 of one of modules 340 rotatably drives an output shaft 602 which in turn drives toothed belt 422 in engagement with gear 423 which is immovably coupled to worm gear 424 (shown in FIG. 11). Worm 424 rotatably drives input portion 504 which is immovably coupled to output portion 508 (shown in FIG. 15) and drive mechanism 358. Drive mechanism 358 is rotated so as to move pressurization system 360 and movable member 542 against the flexible membrane 154 of ink supply 42 (shown in FIG. 3).

At the same time, torque is transmitted from output portion 508 to an adjacent input portion 506 of an adjacent module 340. As a result, any of a number of modules 340 may be releasably interconnected to one another while being driven by a single motor assembly 333. Consequently, the same basic design of ink supply station 340 may be used in printers having different numbers of ink supplies. By enabling the use of the same basic design by printers having differing numbers of ink supplies, the amount of new tooling, design resources, qualification resources and time-to-market necessary to introduce a new printer is reduced. The sharing of ink supply station parts across different printers also reduces common part prices due to economies of scale. With little design effort, the acumen connector assembly 337, support frame 331 and the photo interrupter wiring harness may be easily modified or stretched to accommodate differing numbers of modules 344.

Although the present invention has been described with reference to example embodiments, workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present invention is relatively complex, not all changes in the technology are foreseeable. The present invention described with reference to the example embodiments and set forth in the following claims is manifestly intended to be as broad as possible. For example, unless specifically otherwise noted, the claims reciting a single particular element also encompass a plurality of such particular elements. Furthermore, those dependent claims that do not have limitations phrased in the "means or step for performing a specified function" format permitted by 35 U.S.C. §112, ¶6 are not to be interpreted under §112, ¶6 as being limited solely to the structure, material or acts described in the present application and their equivalents.

What is claimed is:

1. An ink supply station module for use with an ink supply and a first power transmission output portion, the module comprising:

a chassis;

a movable member supported by the chassis, wherein movement of the member causes flow of ink from the ink supply;

a drive mechanism coupled to the movable member and configured to move the member; and a first power transmission input portion supported by the chassis and coupled to the drive mechanism, wherein the input portion is configured to be removably coupled to the first power transmission output portion, wherein the first power transmission input portion is configured to be removably coupled to the first power transmission output portion of another ink supply station module.

2. The module of claim 1, wherein the drive mechanism includes a cam.

3. The module of claim 1 including a second power transmission input portion.

4. The module of claim 3, wherein the second power transmission input portion is configured to be removably coupled to a second power transmission output portion.

5. The module of claim 3, wherein the second power transmission input portion is to be coupled to a motor.

6. The module of claim 1 further comprising a second power transmission input portion, wherein the first power transmission input portion is configured to be releasably coupled to the first power transmission output portion of another ink supply station module and wherein the second power transmission input portion is configured to be coupled to a power transmission output portion of a motor.

7. The module of claim 1 including at least one first locating structure coupled to the chassis and configured to locate the module relative to another module.

8. The module of claim 7, wherein the other module includes one of a receptacle and a projection configured to mate within the receptacle and wherein the locating structure includes the other of the receptacle and the projection.

9. The module of claim 1 including a sensor configured to sense movement of the movable member.

10. The module of claim 9, wherein the sensor is coupled to and carried by the chassis.

11. The module of claim 9, wherein the sensor is resiliently biased towards a predetermined position relative to the chassis.

12. The module of claim 9, wherein the sensor includes:

a body;

a sensing mechanism coupled to the body;

a first prong extending from the body and terminating at a first hook, the first prong configured to slidably engage the chassis; and a second prong extending from the body and terminating at a second hook, the second prong configured to slidably engage the chassis, wherein at least one of the first prong and the second prong is resiliently flexible so as to resiliently bias the first hook and the second hook against the chassis.

13. The module of claim 12, wherein the sensing mechanism includes:

a light receiver; and a light emitter spaced from the receiver and configured to direct light at the emitter.

14. The module of claim 1, wherein the chassis includes:

at least one sensor locator surface configured to engage and locate the sensor; and at least one ink supply locator surface configured to engage and locate the ink supply, wherein the at least one sensor locator surface and the at least one ink supply locator surface are integrally formed as part of a single unitary body.

15. The module of claim 1, wherein the first power transmission input portion includes one of a fluid or pneumatic coupling.

16. The module of claim 1, wherein the first power transmission input portion includes an electrical coupling.

17. The module of claim 16, wherein the drive mechanism includes a solenoid.

18. The module of claim 1 further including a second power transmission output portion and the second power transmission input portion, wherein the first power transmission input portion, the second power transmission input portion, the second power transmission output portion and the drive mechanism are immovably coupled to one another as a single unit.

19. The station of claim 18, wherein the first module includes a first pneumatic coupling and wherein the second module includes a second pneumatic coupling releasably connected to the first pneumatic coupling.

20. The module of claim 1 further comprising a second power transmission input portion.

21. The module of claim 1, wherein the chassis, the movable member, the drive mechanism and the input portion are supported and carried by the chassis so as to be movable as a single unit independent of any other ink supply station modules of the ink supply station.

22. An ink supply station module for use with an ink supply and a first power transmission output portion, the module comprising:

a chassis;

a movable member supported by the chassis, wherein movement of the member causes flow of ink from the ink supply;

a drive mechanism coupled to the movable member and configured to move the member;

a first power transmission input portion supported by the chassis and coupled to the drive mechanism, wherein the input portion is configured to be removably coupled to the first power transmission output portion;

a base member; and a spring operably coupled between the base member and the movable member, wherein the drive mechanism applies force to the base member to move the movable member.

23. The module of claim 22, wherein the spring is captured between the base member and the movable member.

24. The module of claim 22, wherein the movable member is slidably coupled to the base member.

25. The module of claim 22, wherein the base member and the movable member move along a common axis.

26. The module of claim 22, wherein the first power transmission input portion includes a mechanical coupling configured to transmit torque.

27. The module of claim 26, wherein the first input portion includes a gear.

28. The module of claim 26, wherein the first input portion is configured to be keyed to the first output portion.

29. The module of claim 22, wherein the base member is coupled between the movable member and the drive mechanism.

30. An ink supply station for use with a first ink supply and a second ink supply, the station comprising:

a first module including:

a first chassis; and a first movable member supported by the chassis, wherein movement of the member causes flow of ink from the first ink supply; and a second module releasably coupled to the first module, the second module including:

a second chassis;

a second movable member supported by the second chassis, wherein movement of the second member causes flow of ink from the second ink supply;

a first drive mechanism coupled to the first movable member and configured to move the first movable member and wherein the second module includes a second drive mechanism coupled to the second movable member and configured to move the second movable member; and a first mechanical power transmission input portion coupled to the first drive mechanism and wherein the second module includes a first mechanical power transmission output portion releasably connected to the first mechanical power transmission input portion.

31. The station of claim 30, wherein the first module includes a first locator structure and wherein the second module includes a second locator structure configured to mate with the first locator structure to locate the first module relative to the second module.

32. The station of claim 31, wherein the first locator structure includes one of a receptacle and a projection received within the receptacle and wherein the second locator structure includes the other of the receptacle and the projection.

33. The station of claim 30, wherein the second module includes a second mechanical power transmission input portion.

34. The station of claim 30 including a motor having an output shaft coupled to the second mechanical power transmission input portion.

35. The station of claim 34, wherein the output shaft is releasably coupled to the second mechanical power transmission input portion.

36. The station of claim 35, wherein the base member and the first movable member move along a common axis.

37. The station of claim 30, wherein the first module and the second module are identical to one another.

38. The station of claim 30, wherein the first module includes a first sensor coupled to and supported by the first chassis and configured to sense movement of the first movable member and wherein the second module includes a second sensor coupled to and supported by the second chassis and configured to sense movement of the second movable member.

39. The station of claim 38, wherein the first movable member is slidably coupled to the base member.

40. The station of claim 30, wherein the first module includes a first sensor resiliently biased towards a predetermined position relative to the first chassis.

41. The station of claim 30, wherein the chassis includes:

at least one sensor locator surface configured to engage and locate a sensor; and at least one ink supply locator surface configured to engage and locate an ink supply, wherein the at least one sensor locator surface and the at least one ink supply locator surface are integrally formed as part of a single unitary body, wherein the movable member is movable relative to the ink supply locator surface and the at least one sensor locator surface.

42. The station of claim 41, wherein the at least one sensor locator surface and the at least one floor locator surface are formed from a common side of a common mold.

43. The station of claim 30 including a frame releasably coupled to the first module and the second module.

44. The station of claim 30, wherein the first module includes a drive mechanism, wherein the drive mechanism applies force to the base member to move the first movable member.

45. The station of claim 30, wherein the spring is captured between the base member and the movable member.

46. The station of claim 30, wherein the first module includes a first electrical coupling and wherein the second module contains a second electrical coupling releasably connected to the first coupling.

47. The station of claim 30, wherein the first module includes a first hydraulic coupling and wherein the second module includes a second hydraulic coupling releasably connected to the first hydraulic coupling.

48. The station of claim 30 further comprising:

a base member;

a spring operably coupled between the base member and the movable member.

49. The station of claim 48, wherein the base member is coupled between the movable member and the drive mechanism.

50. The station of claim 30, wherein the second module is configured to be removed from the ink supply station and wherein the first module is configured to deliver fluid from the first ink supply while the second module is removed from the ink supply station.

51. An ink supply station for use with a fluid path from an ink reservoir to a printhead and a flexible membrane situated along the fluid path, the station comprising:

a chassis integrally formed as part of a single unitary body;

a movable member movably supported by the chassis and configured to engage the flexible membrane to pressurize ink along the fluid path; and a sensor directly coupled to the chassis and configured to sense movement of the movable member;

wherein the sensor includes:

a body;

a sensing mechanism coupled to the body;

a first prong extending from the body and terminating at a first hook, the first prong slidably engaging the chassis; and a second prong extending from the body and terminating at a second hook, the second prong slidably engaging the chassis, wherein at least one of the first prong and the second prong is resiliently flexible so as to resiliently bias the first hook and the second hook against the chassis.

52. The station of claim 51, wherein the sensor is resiliently biased towards a predetermined position relative to the chassis.

53. The station of claim 51 including:

a frame; and a module releasably coupled to the frame, wherein the module includes the chassis and the movable member.

54. The station of claim 51 including:

a first module; and a second module releasably coupled to the first module, wherein the second module includes the chassis and the movable member.

55. The station of claim 51, wherein the chassis includes at least one floor surface adapted to engage an ink supply to locate the ink supply relative to the movable member.

56. The station of claim 55, wherein the chassis includes at least one sensor locator surface adapted to engage and locate the sensor relative to the chassis and wherein the at least one floor surface is integrally formed as part of a single unitary body with the at least one sensor locator surface.

57. The station of claim 56, wherein the at least one sensor locator surface and the at least one floor surface are formed from a common side of a common mold.

58. The station of claim 51, wherein the sensing mechanism includes:

a light receiver; and a light emitter spaced from the receiver and configured to direct light at the emitter.

59. The station of claim 58, wherein the movable member includes a flag and wherein the sensor senses a position of the flag between the receiver and the emitter.

60. An ink supply system comprising:

an ink reservoir;

a fluid passage extending from the reservoir;

a flexible membrane adjacent the fluid passage; and a pressurization system including:

a movable member;

a base member; and a spring coupled between the base member and the movable member; and a drive mechanism configured to apply force to the base member to move the movable member so as to move the membrane.

61. The system of claim 60, wherein the drive mechanism includes a cam.

62. The system of claim 60 including an ink supply, wherein the ink supply includes the ink reservoir, the fluid passage and the flexible membrane.

63. The system of claim 62 including a module having a chassis coupled to and supporting the movable member, the base member, the spring and the drive mechanism.

64. The system of claim 63, wherein the module includes a mechanical power transmission output portion configured to be releasably coupled to a mechanical power transmission input portion of another module.

65. The system of claim 60, wherein the base member is coupled between the movable member and the drive mechanism.

66. An ink supply station module for use with an ink supply and a first power transmission output portion, the module comprising:

a chassis;

a movable member supported by the chassis, wherein movement of the member causes flow of ink from the ink supply;

a drive mechanism coupled to the movable member and configured to move the member; and a first power transmission input portion supported by the chassis and coupled to the drive mechanism, wherein the input portion is configured to be removably coupled to the first power transmission output portion; and a second power transmission input portion, wherein the first power transmission input portion is configured to be releasably coupled to the first power transmission input portion of another ink supply station module and wherein the second power transmission input portion is configured to be coupled to a power transmission output portion of a motor.

67. An ink supply station for use with a first ink supply and a second ink supply, the station comprising:

a first module including:

a first chassis; and a first movable member supported by the chassis, wherein movement of the member causes flow of ink from the first ink supply; and a second module releasably coupled to the first module, the second module including:

a second chassis;

a second movable member supported by the second chassis, wherein movement of the second member causes flow of ink from the second ink supply;

a base member; and a spring operably coupled between the base member and the movable member, wherein the first module includes a drive mechanism, wherein the drive mechanism applies force to the base member to move the first movable member.

* * * * *

UNITED STATES PATENT AND TRADEMARK OFFICE

CERTIFICATE OF CORRECTION

PATENT NO. : 7,207,666 B2
APPLICATION NO. : 10/636925
DATED : April 24, 2007
INVENTOR(S) : Jason S. Ord et al.

It is certified that error appears in the above-identified patent and that said Letters Patent is hereby corrected as shown below:

In column 12, line 62, in Claim 5, after "is" insert -- configured --.

Signed and Sealed this

Sixteenth Day of September, 2008

JON W. DUDAS
*Director of the United States Patent and Trademark Office*